US009638437B2

(12) United States Patent
Hong et al.

(10) Patent No.: US 9,638,437 B2
(45) Date of Patent: May 2, 2017

(54) STRUCTURE FOR FIXING COMPRESSOR FOR DEHUMIDIFIER

(71) Applicants: COWAY CO., LTD, Chungcheong-nam-do (KR); WINIX INC., Gyeonggi-do (KR)

(72) Inventors: Hyun-Jin Hong, Seoul (KR); Chan-Jung Park, Seoul (KR); Sang-Woo Kang, Seoul (KR)

(73) Assignee: COWAY CO., LTD., Chungcheong-nam-do (KR)

( * ) Notice: Subject to any disclaimer, the term of this patent is extended or adjusted under 35 U.S.C. 154(b) by 235 days.

(21) Appl. No.: 14/382,925

(22) PCT Filed: Mar. 12, 2013

(86) PCT No.: PCT/KR2013/001957
§ 371 (c)(1),
(2) Date: Sep. 4, 2014

(87) PCT Pub. No.: WO2013/141512
PCT Pub. Date: Sep. 26, 2013

(65) Prior Publication Data

US 2015/0047383 A1 Feb. 19, 2015

(30) Foreign Application Priority Data

Mar. 20, 2012 (KR) ..... 10-2012-0028511

(51) Int. Cl.
*F24F 1/00* (2011.01)
*F24F 13/24* (2006.01)
(Continued)

(52) U.S. Cl.
CPC ..... *F24F 13/24* (2013.01); *F04D 29/668* (2013.01); *F24F 13/32* (2013.01); *F25D 23/006* (2013.01);
(Continued)

(58) Field of Classification Search
CPC ..... F24F 13/24; F24F 13/32; F24F 2003/144; F04D 29/668; F25D 23/006; F25B 2500/13
(Continued)

(56) References Cited

U.S. PATENT DOCUMENTS 4,643,386 A 2/1987 Chastine
6,011,336 A * 1/2000 Mathis ..... F16F 1/376 248/628
(Continued)

FOREIGN PATENT DOCUMENTS

CN 1991168 7/2007
CN 101910763 12/2010
(Continued)

OTHER PUBLICATIONS

International Search Report. PCT/KR2013/001957 (2 Pages) Dated: May 27, 2013.
(Continued)

*Primary Examiner* — Anita M King
(74) *Attorney, Agent, or Firm* — Dority & Manning, P.A.

(57) ABSTRACT

There is provided a compressor fixing structure capable of preventing vibrations from a compressor from being spread to the entirety of a product in which the compressor is installed. The compressor fixing structure includes: a plurality of support units disposed to have a polygonal structure and protruded from a bottom surface; a support unit anti-vibration rib protruded from a perimeter of each of the plurality of support units; and an outer anti-vibration rib surrounding the entirety of the plurality of support units and protruded from a bottom surface. Spreading of vibrations from a compressor installed in a product is minimized, reducing vibrations and noise generated by the compressor when the compressor is driven.

9 Claims, 4 Drawing Sheets

(51) Int. Cl.

| | |
|---|---|
| ***F24F 13/32*** | (2006.01) |
| ***F25D 23/00*** | (2006.01) |
| ***F04D 29/66*** | (2006.01) |
| *F24F 3/14* | (2006.01) |

(52) U.S. Cl.
CPC ..... *F24F 2003/144* (2013.01); *F25B 2500/13* (2013.01)

(58) Field of Classification Search
USPC ..... 248/638, 346.01, 678
See application file for complete search history.

(56) References Cited

U.S. PATENT DOCUMENTS 6,132,183 A * 10/2000 Li ..... F04B 39/0033 248/638
6,336,794 B1 * 1/2002 Kim ..... F04B 39/0044 417/363
6,354,558 B1 * 3/2002 Li ..... F16F 15/08 248/615
6,863,253 B2 * 3/2005 Valentz ..... E04D 13/12 248/125.8
2007/0148013 A1 6/2007 Hong et al.

FOREIGN PATENT DOCUMENTS

| | | |
|---|---|---|
| CN | 201934290 | 8/2011 |
| JP | 03-110329 A | 5/1991 |
| JP | 2000-205590 A | 7/2000 |
| JP | 2009-174842 A | 8/2009 |
| KR | 0512240 B1 | 2/2005 |
| KR | 20040078938 | 9/2005 |

OTHER PUBLICATIONS

Written Opinion of the International Searching Authority PCT/KR2013/001957 (4 Pages) Dated: May 27, 2013.
State Intellectual Property Office of China (SIPO) Chinese Office Action, dated Jun. 28, 2016 (6 pages).

* cited by examiner

STRUCTURE FOR FIXING COMPRESSOR FOR DEHUMIDIFIER

CROSS REFERENCE TO RELATED APPLICATIONS

This application is the U.S. National Stage entry of International Application Number PCT/KR2013/1001957 filed under the Patent Cooperation Treaty having a filing date of Mar. 12, 2013, which claims priority to Korean Patent Application Serial Number 10-2012-0028511 having a filing date of Mar. 20, 2012.

TECHNICAL FIELD

The present invention relates to a structure for fixing a compressor for a dehumidifier and, and more particularly, to a compressor fixing structure for a dehumidifier capable of preventing vibrations of a compressor from being spread to the entirety of a product in which the compressor is installed.

BACKGROUND ART

In general, a dehumidifier is a device allowing humid air in an indoor space to be drawn into the interior of a case to pass through a heat exchanger including a condenser and an evaporator in which a refrigerant flows, to thus lower humidity, and allowing the dehumidified air to be provided to the indoor area to thus lower humidity in the indoor area.

A dehumidifier cools air to below a dew point thereof, generating condensed water, removing an amount of moisture contained in the air equal to the amount of the condensed water to lower humidity, and in general, a dehumidification method using a refrigerating cycle is commonly used.

In general, a dehumidification method using a refrigerating cycle may include a heat exchanger including an evaporator and a condenser, a compressor circulating a refrigerant in the heat exchanger, and a fan for drawing in air.

An operation of a dehumidifier will be described. First, when a dehumidifier operates, a compressor is driven and a refrigerant is circulated in a condenser and an evaporator. A fan is rotated to allow ambient humid air to sequentially pass through the evaporator and the condenser. Accordingly, dehumidified air is discharged to the outside of the dehumidifier.

Here, as the compressor is operated, a large amount of vibrations may be generated thereby.

FIG. 1 is a perspective view illustrating a structure for fixing a compressor 10 installed in a related art dehumidifier.

Referring to FIG. 1, the compressor 10 is installed in one side of a base structure of a dehumidifier. The related art dehumidifier has a structure in which leg portions 12 of the compressor 10 are fixed to a fixing portions 20 protruded from an injection-molded product of the base structure.

Also, anti-vibration rubber (or shock-absorbing rubber) may be used in a portion of the base structure in which the compressor 10 is fixed. However, such a structure has a limitation in preventing vibrations of the compressor 10 from being transferred to the base structure and spreading to the entire dehumidifier. In addition, vibrations generated by the compressor 10 may cause a relatively loud noise when the dehumidifier operates.

Thus, a technique for effectively preventing vibrations of the compressor 10 from being spread to the entire dehumidifier is required.

DISCLOSURE OF INVENTION

Technical Problem

An aspect of the present invention provides a compressor fixing structure capable of reducing vibrations and noise generated by a compressor when a device in which a compressor is installed is driven.

Solution to Problem

According to an aspect of the present invention, there is provided a compressor fixing structure including: a plurality of support units disposed to have a polygonal structure and protruded from a bottom surface; a support unit anti-vibration rib protruded from a perimeter of each of the plurality of support units; and an outer anti-vibration rib surrounding the entirety of the plurality of support units and protruded from a bottom surface.

The polygonal structure formed by the plurality of support units may have an equilateral triangular shape or a square shape.

The compressor fixing structure may further include: inner anti-vibration ribs protruded from an inner bottom surface of the outer anti-vibration rib.

The inner anti-vibration ribs may include a connection anti-vibration rib connecting adjacent support units among the plurality of support units.

The inner anti-vibration ribs may include an intersection anti-vibration rib traversing the polygon formed by the plurality of support units from each of the plurality of support units.

The inner anti-vibration ribs may include a circular anti-vibration rib having a radius shorter than a distance from the center of gravity of the polygon formed by the plurality of support units to each of the plurality of support units, when the center of gravity is the center.

The intersection anti-vibration rib may pass through the center of gravity of the polygon formed by the plurality of support units and extend to be connected to the outer anti-vibration rib.

The circular anti-vibration rib may be in contact with the connection anti-vibration rib.

The compressor fixing structure may further include a perimeter anti-vibration rib formed along the perimeter of the compressor fixing structure.

The outer anti-vibration rib may be higher than the inner anti-vibration ribs.

Advantageous Effects of Invention

According to embodiments of the present invention having the foregoing configuration, spreading of vibrations from the compressor installed in a product to an outer side thereof can be minimized. Thus, when the compressor is driven, vibrations and noise generated by the compressor can be reduced.

BEST MODE FOR CARRYING OUT THE INVENTION

The terminology used herein is used for the purpose of describing particular embodiments only and is not intended to be limiting of the invention. Also, as used herein, singular forms "a", "an" and "the" are intended to include the plural forms as well, unless the context clearly indicates otherwise.

It will be further understood that terms such as "including" or "having," etc., are intended to indicate the existence of the features, numbers, operations, actions, components, parts, or combinations thereof disclosed in the specification, and are not intended to preclude the possibility that one or more other features, numbers, operations, actions, components, parts, or combinations thereof may exist or may be added.

Embodiments of the present invention will be described in detail with reference to the accompanying drawings.

First, a compressor fixing structure according to an embodiment of the present invention will be described with reference to FIGS. 2 and 3. Here, FIG. 2 is a perspective view illustrating a compressor fixing structure according to an embodiment of the present invention, and FIG. 3 is a plan view of the compressor fixing structure.

In the present disclosure, a compressor fixing structure installed in a dehumidifier is described for the purposes of description, but an application of the compressor fixing structure according to an embodiment of the present invention is not limited to a dehumidifier.

Figure 2:
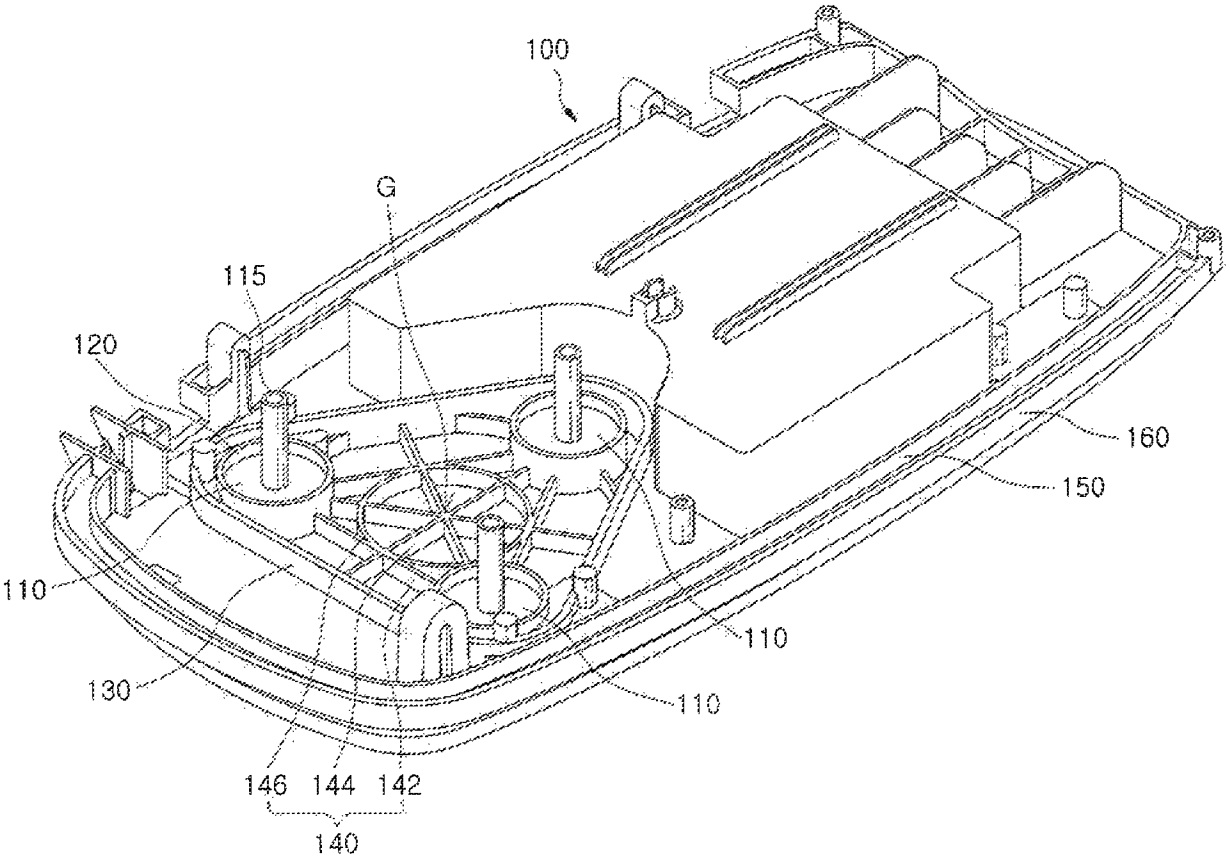
FIG. 2 is a perspective view illustrating a compressor fixing structure according to an embodiment of the present invention.
Figure 3:
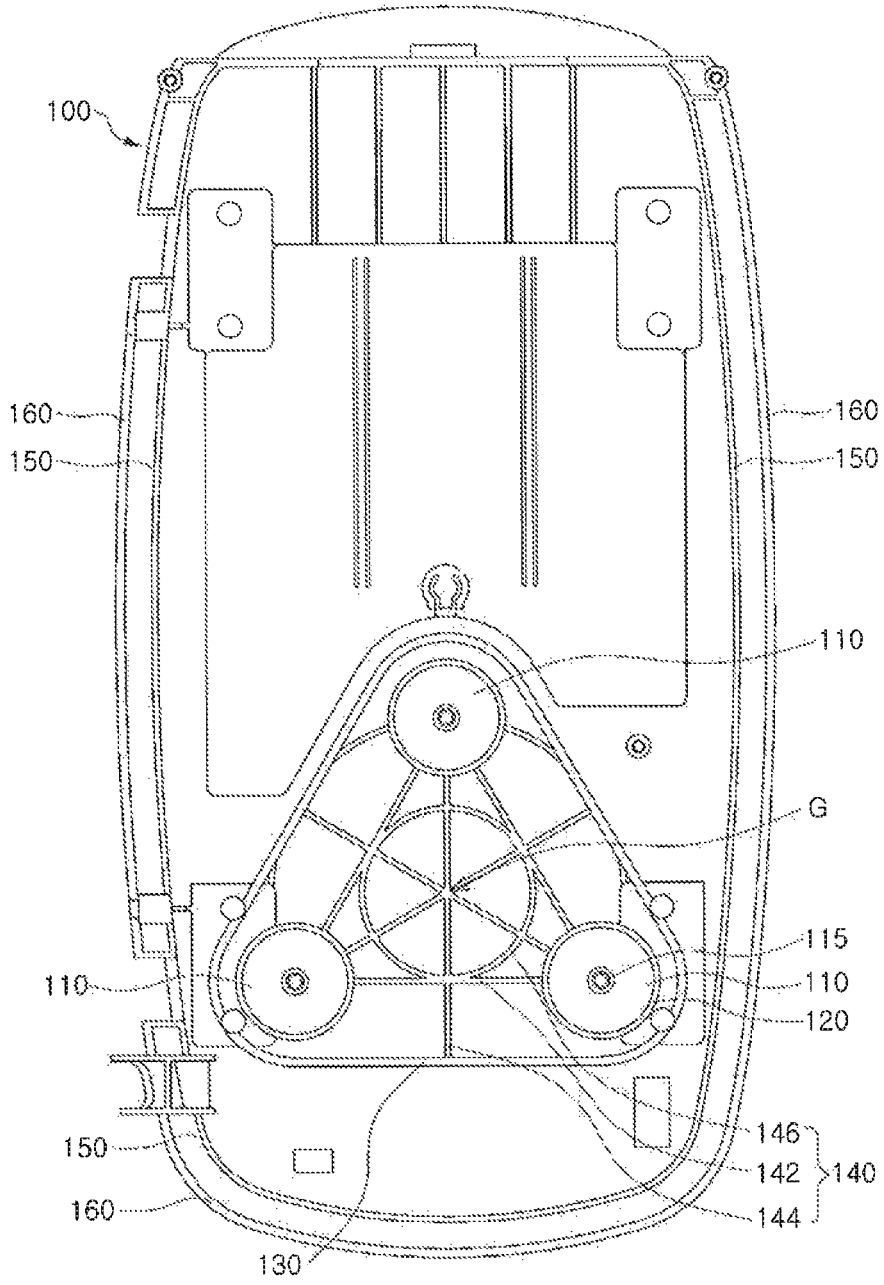
FIG. 3 is a plan view of the compressor fixing structure illustrated in FIG. 2.

As illustrated in FIGS. 2 and 3, the compressor fixing structure 100 according to an embodiment of the present invention may include a support unit 110, a support unit anti-vibration rib for a support unit shock absorbing rib) 120, and an outer anti-vibration rib 130, and may further include an inner anti-vibration rib 140 formed within the outer anti-vibration rib 130, and a perimeter anti-vibration rib 150 formed along the contour of the compressor fixing structure 100.

In an embodiment, the compressor fixing structure 100 according to an embodiment of the present invention may correspond to a lower housing of a dehumidifier.

A plurality of support units 110 may be provided, disposed to form a polygonal structure, and may be protruded from a bottom surface of the compressor fixing structure 100.

The support units 110 support leg portions of a compressor, and in order for a cylindrical compressor to be stably installed, the support units 110 may be disposed to have an equilateral triangular structure or a square structure on the bottom surface of the compressor fixing structure 100. In the embodiment illustrated in FIGS. 2 and 3, the support portions 110 are disposed to have an equilateral triangular structure.

However, the structure of the support units 110 may not be limited to the equilateral triangular structure and various other structures such as a square structure, a rectangular structure, a pentagonal structure, and the like, may also be used.

The support unit 110 may have a cylindrical shape and may be formed to be protruded upwardly from the bottom surface of the compressor fixing structure 100 through a forming process.

Also, in an embodiment, a fastening pin 115 may be formed on an upper end of the support unit 110 to allow a leg portion of the compressor to be fastened thereto.

Meanwhile, the support unit anti-vibration rib 120 may be protruded from the perimeter of the support unit 110, in the form of a fence surrounding the perimeter. The support unit anti-vibation rib 120 may have a thickness and height such that the leg portion 12 of the compressor 10 is not hampered from being installed in an upper end of the support 110, and may be integrally formed with the support unit 110 in the compressor fixing structure 100 through a forming process.

Meanwhile, the outer anti-vibration rib 130 may be protruded from the bottom surface surrounding the entirety of the plurality of support units 110. Namely, as illustrated in FIGS. 2 and 3, in an embodiment, the outer anti-vibration rib 130 may cover the entirety of the support units 110 disposed to have an equilateral triangular structure at an outer side.

Thus, the configuration of the outer anti-vibration rib 130 may be determined according to a disposition structure of the support units 110, and in the embodiment illustrated in FIGS. 2 and 3, the outer anti-vibration rib 130 may have an equilateral triangular shape with rounded vertexes.

Also, like the support unit 110, the outer anti-vibration rib 130 may be formed to be protruded from the bottom surface of the compressor fixing structure 100, like a fence, through a forming process.

Meanwhile, the inner anti-vibration rib 140 may be protruded from an inner bottom surface of the compressor fixing structure 100 in a portion surrounded by the outer anti-vibration rib 130.

In an embodiment, the inner anti-vibration rib 140 may include a connection anti-vibration rib 142, an intersection anti-vibration rib 144, and a circular anti-vibration rib 146.

Here, the connection anti-vibration rib 142 may have a structure connecting adjacent support units 110 among the plurality of support units 110. Namely, as illustrated in FIGS. 2 and 3, the connection anti-vibration rib 142 may have a linear shape linking the adjacent support unit 110 at the shortest distance, and may be integrally formed on outer walls of the support units 110.

Meanwhile, the intersection anti-vibration rib 144 may have a structure traversing a polygon formed by the plurality of support units 110 from each of the plurality of support units 110. Namely, as illustrated in FIGS. 2 and 3, the intersection anti-vibration rib 144 may be formed as a linear rib facing the opposite side of the equilateral triangular shape formed by the plurality of support units 110 in each of the plurality of support units 110.

Here, like the connection anti-vibration rib 142, one end of the intersection anti-vibration rib 144 may be integrally formed on an outer wall of the support unit 110, and the other end thereof may be connected to the outer anti-vibration rib 130.

In an embodiment, in a case in which the plurality of support units 110 have an equilateral triangular structure, the intersection anti-vibration rib 144 may be formed at a point at which angles formed by two connection anti-vibration ribs 142 is halved. In comparison, when the plurality of support units 110 are disposed to have a square structure, a diagonal line having a square shape may be formed.

Also, in the embodiment illustrated in FIGS. 2 and 3, the intersection anti-vibration ribs 144 connected to the respective support units 110 may intersect each other at one point which corresponds to the center of gravity G of the equilateral triangular shape formed by the plurality of support units 110.

Meanwhile, when the center of gravity G of the polygon formed by the plurality of support units 110 is the center, the circular anti-vibration rib 146 may be formed as a circular rib having a radius shorter than a distance from the center of gravity G to the support unit 110. The circular anti-vibration rib 146 may be intersected by the connection anti-vibration rib 142 and the intersection anti-vibration rib 144 such that behaviors thereof are integrated.

Also, as illustrated in FIGS, 2 and 3, the circular anti-vibration rib 146 may be formed to be in contact with the connection anti-vibration rib 142. In such a case, vibrations may be more readily transferred between the connection anti-vibration rib 142 and the circular anti-vibration rib 146, and spreading of vibrations of the anti-vibration ribs may be more effectively prevented by the circular anti-vibration rib 146. Namely, when vibrations are transferred from the support unit 110 to the connection anti-vibration rib 142, the vibrations are transferred to the circular anti-vibration rib 146 and whirled around the circular anti-vibration rib 146.

If the connection anti-vibration rib 142 intersects the circular anti-vibration rib 146 or is separated therefrom, rather than being in contact with the circular anti-vibration rib 146, vibrations may spread outwardly from the connection anti-vibration rib 142 or may not be transferred to the connection anti-vibration rib 142.

Meanwhile, preferably, the connection anti-vibration rib 142, the intersection anti-vibration rib 144, and the circular anti-vibration rib 146 are integrally formed through a forming process of the compressor fixing structure 110, and also, preferably, the respective ribs are intersected and connected integrally such that behaviors thereof are integrated.

Also, as illustrated in FIG. 2, in an embodiment, all inner anti-vibration ribs 140 may have the same height, and the outer anti-vibration rib 130 may be higher than the inner anti-vibration ribs 140.

Meanwhile, the perimeter anti-vibration rib 150 formed along the perimeter of the compressor fixing structure 100 may be formed within an edge frame 160 of the compressor fixing structure 100 at a predetermined interval from the edge from 160.

In an embodiment, as illustrated in FIGS. 2 and 3, the outer anti-vibration rib 160 may have a shape corresponding to a shape of the edge frame 160 forming a housing, and accordingly, the compressor fixing structure 100 may be configured to have dual outer walls.

Figure 4:
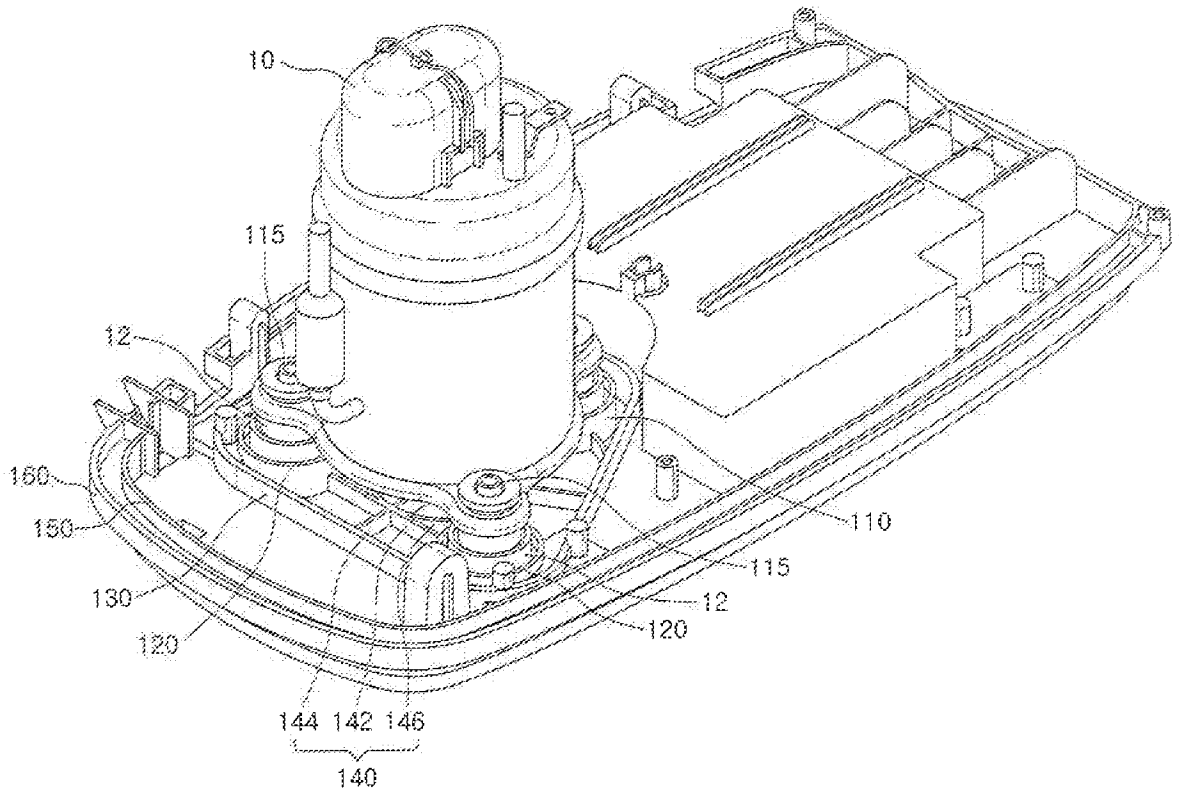
FIG. 4 is a perspective view illustrating a state in which a compressor is installed in the compressor fixing structure illustrated in FIG. 2.

FIG. 4 is a perspective view illustrating a state in which the compressor 10 is installed in the compressor fixing structure 100 according to an embodiment of the present invention.

Referring to FIG. 4, the leg portion 12 of the compressor 10 installed in a dehumidifier may be installed in the support unit 110 of the compressor fixing structure 100. Here, the fastening pin 115 provided in the support unit 110 may be inserted in a hollow of the leg portion 12. A bolt (not shown) for coupling the leg portion 12 and the fastening pin 115 may be fastened to an upper end of the fastening pin 115.

When the compressor 10 installed thusly is driven, vibrations may be generated from the compressor 10, and in this case, the vibrations generated from the compressor 10 may be first dissipated by the support unit anti-vibration ribs 120. Also, the vibrations from the support units 110 may be secondarily transferred to the inner anti-vibration ribs 140 directly and indirectly connected to the support units 110, and in this case, the vibrations transferred to the inner anti-vibration ribs 140 may be collected in the center through the circular anti-vibration rib 146 and the intersection anti-vibration rib 144, thus preventing the vibrations from being spread to the outer side at a predetermined level.

Also, the outer anti-vibration rib 130 serving to vibrations from the support units 110 and those from the inner anti-vibration ribs 140 from being spread outwardly in the installation range of the compressor 10 may tertiarily attenuate vibrations Also, the perimeter anti-vibration rib 150 may quarternarily prevent vibrations from being spread to a case part of the dehumidifier from the compressor fixing structure 100.

The anti-vibration ribs may vibrate by themselves to attenuate vibrations of the dehumidifier overall.

Figure 1:
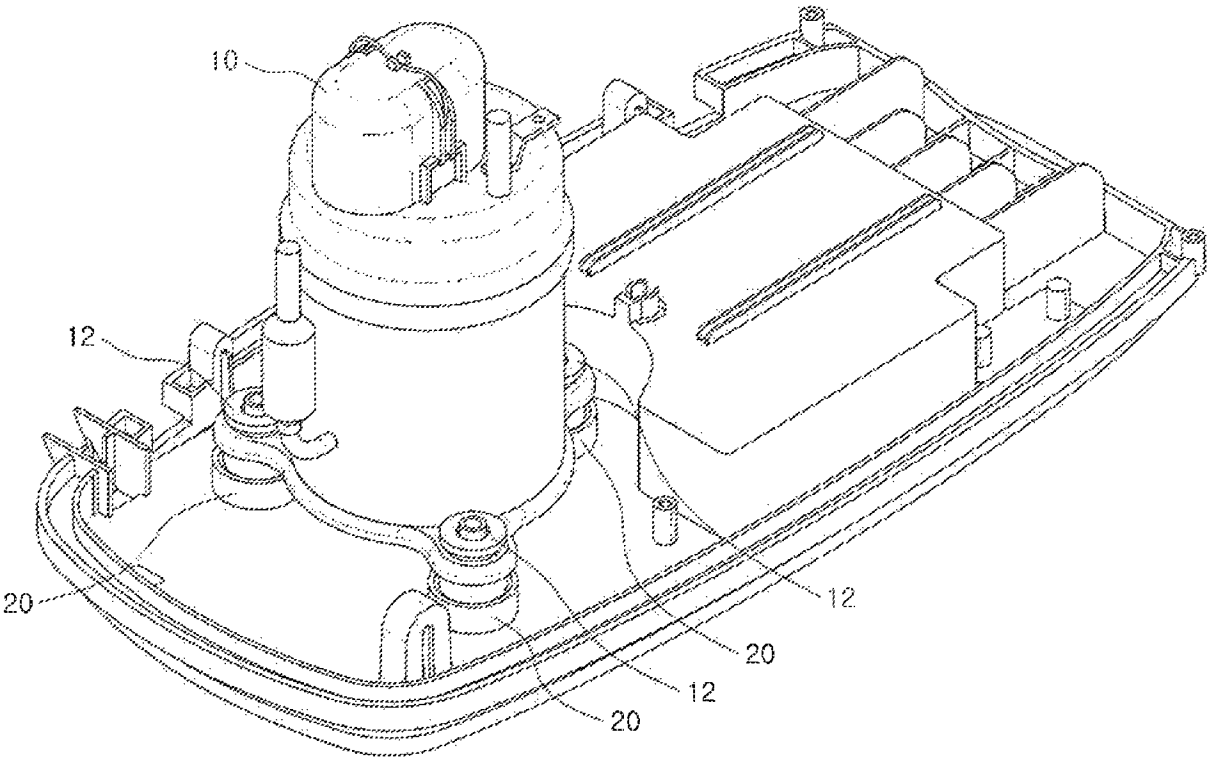
PRIOR ART FIG. 1
FIG. 1 is a perspective view illustrating a related art compressor fixing structure.

For reference, test results obtained by installing the compressor 10 in the compressor fixing structure 100 according to an embodiment of the present invention and in the related art base structure illustrated in FIG. 1 show that the related art base structure was measured to have 37.5 dB and the compressor fixing structure 100 according to an embodiment of the present invention was measured to have 36.2 dB, indicating that the compressor fixing structure 100 according to an embodiment of the present invention had an effect of reducing vibration noise by 1.3 dB, relative to the related art base structure.

The invention claimed is:

1. A compressor fixing structure comprising:

a plurality of support units disposed to have a polygonal structure and protruded from a bottom surface;

a support unit anti-vibration rib protruded from a perimeter of each of the plurality of support units;

an outer anti-vibration rib surrounding the entirety of the plurality of support units and protruded from the bottom surface; and inner anti-vibration ribs protruded from an inner bottom surface of the outer anti-vibration rib.

2. The compressor fixing structure of claim 1, wherein the polygonal structure formed by the plurality of support units has an equilateral triangular shape or a square shape.

3. The compressor fixing structure of claim 1, wherein the inner anti-vibration ribs include a connection anti-vibration rib connecting adjacent support units among the plurality of support units.

4. The compressor fixing structure of claim 1, wherein the inner anti-vibration ribs include an intersection anti-vibration rib traversing a polygon formed by the plurality of support units from each of the plurality of support units.

5. The compressor fixing structure of claim 1, wherein the inner anti-vibration ribs include a circular anti-vibration rib having a radius shorter than a distance from the center of gravity of a polygon formed by the plurality of support units to each of the plurality of support units, when the center of gravity is the center.

6. The compressor fixing structure of claim 4, wherein the intersection anti-vibration rib passes through the center of gravity of the polygon formed by the plurality of support units and extends to be connected to the outer anti-vibration rib.

7. The compressor fixing structure of claim 1, wherein the inner anti-vibration ribs comprises:

a connection anti-vibration rib connecting adjacent support units among the plurality of support units; and a circular anti-vibration rib having a radius shorter than a distance from the center of gravity of a polygon formed by the plurality of support units to each of the plurality of support units, when the center of gravity of the polygon is the center of the circular anti-vibration rib, and wherein the circular anti-vibration rib is in contact with the connection anti-vibration rib.

8. The compressor fixing structure of claim 1, wherein the outer anti-vibration rib is higher than the inner anti-vibration ribs.

9. A compressor fixing structure, comprising:

a plurality of support units disposed to have a polygonal structure and protruded from a bottom surface;

a support unit anti-vibration rib protruded from a perimeter of each of the plurality of support units;

an outer anti-vibration rib surrounding the entirety of the plurality of support units and protruded from the bottom surface; and a perimeter anti-vibration rib formed along the perimeter of the compressor fixing structure.

* * * * *